US009545143B1

(12) United States Patent
Jacob et al.

(10) Patent No.: US 9,545,143 B1
(45) Date of Patent: Jan. 17, 2017

(54) MOLDED MASCARA BRUSH HEAD WITH RAKE-LIKE TEETH

(71) Applicant: ELC MANAGEMENT LLC, Melville, NY (US)

(72) Inventors: Christophe Jacob, Roussillon (FR); Herve F. Bouix, New York, NY (US)

(73) Assignee: ELC Management LLC, Melville, NY (US)

( * ) Notice: Subject to any disclaimer, the term of this patent is extended or adjusted under 35 U.S.C. 154(b) by 18 days.

(21) Appl. No.: 14/844,794

(22) Filed: Sep. 3, 2015

Related U.S. Application Data

(60) Provisional application No. 62/186,720, filed on Jun. 30, 2015.

(51) Int. Cl.
*A46B 9/00* (2006.01)
*A45D 40/26* (2006.01)
*A46B 9/02* (2006.01)

(52) U.S. Cl.
CPC ..... *A45D 40/267* (2013.01); *A46B 9/021* (2013.01); *A46B 9/028* (2013.01)

(58) Field of Classification Search
CPC ..... A46B 9/00; A46B 9/028
USPC ..... 401/121–127, 129; 132/212, 216, 218
See application file for complete search history.

(56) References Cited

U.S. PATENT DOCUMENTS

| | | | |
|---|---|---|---|
| 5,020,551 | A | 6/1991 | Guerret |
| 2004/0112400 | A1 | 6/2004 | Kurek |
| 2005/0040693 | A1 | 2/2005 | Montoli et al. |
| 2011/0229246 | A1 | 9/2011 | Kulik |
| 2012/0060859 | A1 | 3/2012 | Wyatt et al. |

FOREIGN PATENT DOCUMENTS

| | | |
|---|---|---|
| WO | WO-2010/013213 | 2/2010 |

OTHER PUBLICATIONS

PCT International Search Report, International Application No. PCT/US2015/066343; Completion Date: Feb. 26, 2016; Date of Mailing: Apr. 6, 2016.
PCT Written Opinion of the International Searching Authority: International Application No. PCT/US2015/066343; Completion Date: Feb. 26, 2016; Mailing Date: Apr. 6, 2016.

*Primary Examiner* — David Walczak
*Assistant Examiner* — Joshua Wiljanen
(74) *Attorney, Agent, or Firm* — Martin W. Haerter

(57) ABSTRACT

A cosmetic package is provided with an applicator brush head that has rake-like teeth extending from the core of the brush head. Each tooth has a flexible vertical post extending from the brush core to a horizontal beam. Several tines extend vertically from the beam to free ends. When the brush is drawn through a wiper in the product vial, the flexible vertical post allows the rake teeth to bend such that the tines pick up cosmetic product deposited at or near the core of the brush. As the brush head leaves the wiper, the rake-like teeth return to an upright position carrying the cosmetic product at or near the free ends of the tines.

17 Claims, 8 Drawing Sheets

FIG. 2
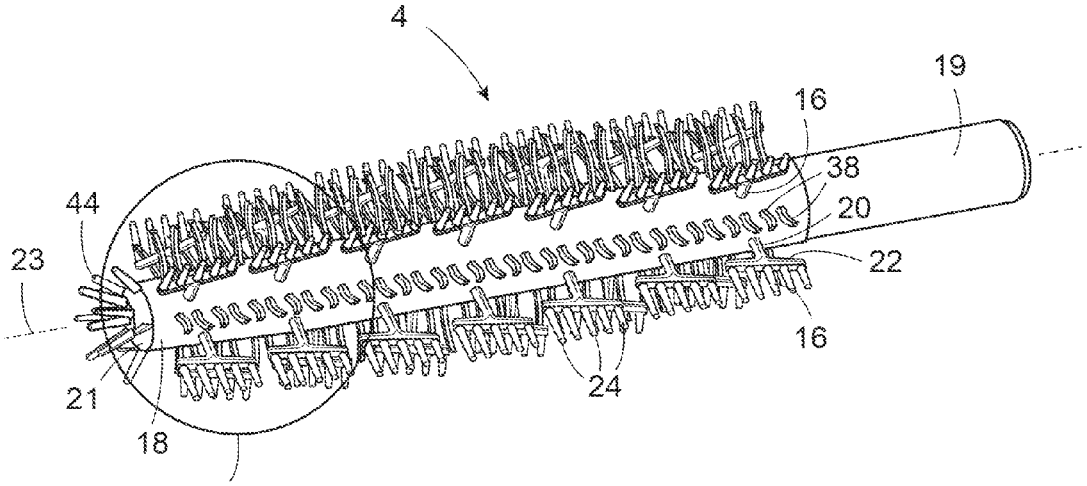
FIG. 3
FIG. 3
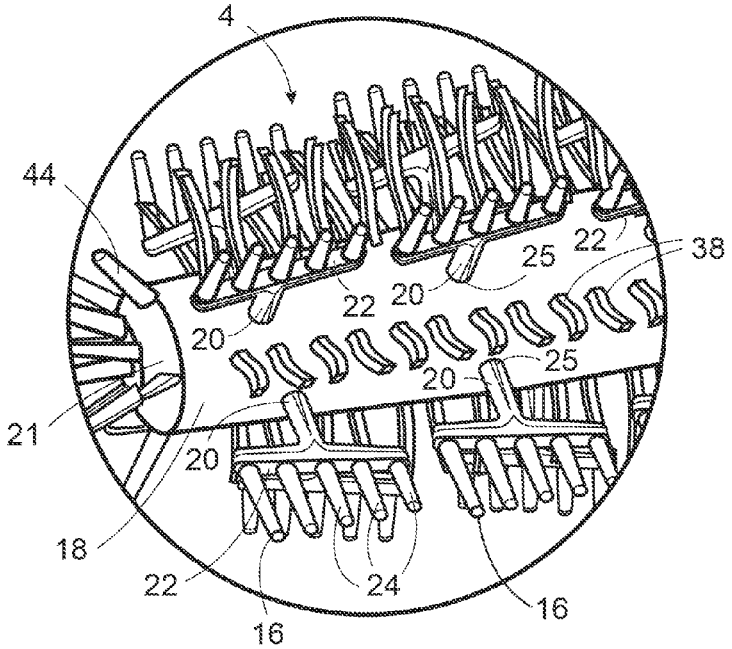

MOLDED MASCARA BRUSH HEAD WITH RAKE-LIKE TEETH

CROSS-REFERENCE TO RELATED APPLICATIONS

The present application claims priority from U.S. Provisional Application No. 62/186,720, filed Jun. 30, 2015.

BACKGROUND OF THE INVENTION

Field of the Invention

The present invention is a cosmetic applicator, more precisely a molded applicator brush. In particular, the present invention is directed to a cosmetic applicator brush for the application of mascara products to eyelashes or brow cosmetic products to eyebrows.

Description of the Prior Art

Molded cosmetic applicator brushes comprising several rows of fine plastic teeth, tines or bristles are well known. Many of these molded brushes include rows comprising a plurality of fine teeth, tines or bristles along the longitudinal axis of the brush core, the rows arranged radially, in a circular duplication of from 4 to 12 rows around the core. Generally, the profile or the design of these teeth, tines or bristles is the same along the length of the brush. Also, these teeth, tines or bristles each have a circular or semi-circular cross-section which is perpendicular to the core of the brush. Many of these standard molded brushes have generally straight teeth.

A problem with the prior art molded brushes is that a majority of the cosmetic product loaded on the brush tends to be accumulated at or close to the core of the brush after the brush is withdrawn from the product vial through a wiper. Yet, cosmetic application, particularly to hair and lashes is better accomplished if the majority of cosmetic product, e.g., mascara or eyebrow cosmetic, is loaded on the molded applicator at or near the surface of the brush defined by the free ends of the teeth, tines or bristles that make up the brush. However, with present applicator and vial designs, as the applicator is withdrawn from the vial, it passes through a wiper. The wiper removes excess cosmetic product near the free ends of the teeth, tines or bristles, i.e., near the surface of the brush defined by the free ends of the teeth, tines or bristles, and pushes the remaining product on the applicator away from the free ends toward the core of the applicator, i.e., at or near the base of the teeth, tines or bristles. Thus, as a conventional brush is withdrawn through a wiper, the majority of cosmetic product, e.g., mascara, is deposited and located near the core of the brush and not at the tips of the teeth, tines or bristles of the brush where it would be readily available for application. It is also known that lashes may not easily penetrate the surface of the brush to pass between the teeth, tines or bristles to access the cosmetic product loaded at or near the core of the brush.

Accordingly, there is a need for an applicator that retains and carries more cosmetic product at or near the relative surface of the applicator, i.e., at or near the free ends of the teeth, tines or bristles, after passing through the wiper.

BRIEF SUMMARY OF THE INVENTION

It is an object of the invention to provide a molded cosmetic applicator brush which carries more cosmetic product at or near the surface of the applicator, i.e., at or near the free ends of the teeth, tines or bristle after passing through the vial wiper.

It is a further object of this invention to provide a molded cosmetic applicator brush that loads combs, separates and increases the volume of cosmetic delivered on the eyelashes.

It is a further object of this invention to provide an increased make-up definition and an increased appearance of volume (a "volumizing effect") for each lash or brow. The "teeth" of this brush are new and have a unique design.

A cosmetic package is provided with an applicator brush head that has rake-like teeth extending from the core of the brush head. Each tooth has a flexible vertical post extending from the brush core to a horizontal beam. Several tines extend vertically from the beam to free ends. When the brush is drawn through a wiper in the product vial, the flexible vertical post allows the rake teeth to bend such that the tines pick up cosmetic product deposited at or near the core of the brush. As the brush head leaves the wiper, the rake-like teeth return to an upright position carrying the cosmetic product at or near the free ends of the tines.

BRIEF DESCRIPTION OF THE DRAWINGS

FIG. 2 is a bottom, front and right side perspective view of a brush head portion of the cosmetic applicator shown in FIG. 1;

FIG. 3 is an enlarged view of a portion of the brush head portion shown in FIG. 2;

DETAILED DESCRIPTION OF THE INVENTION

Figure 1:
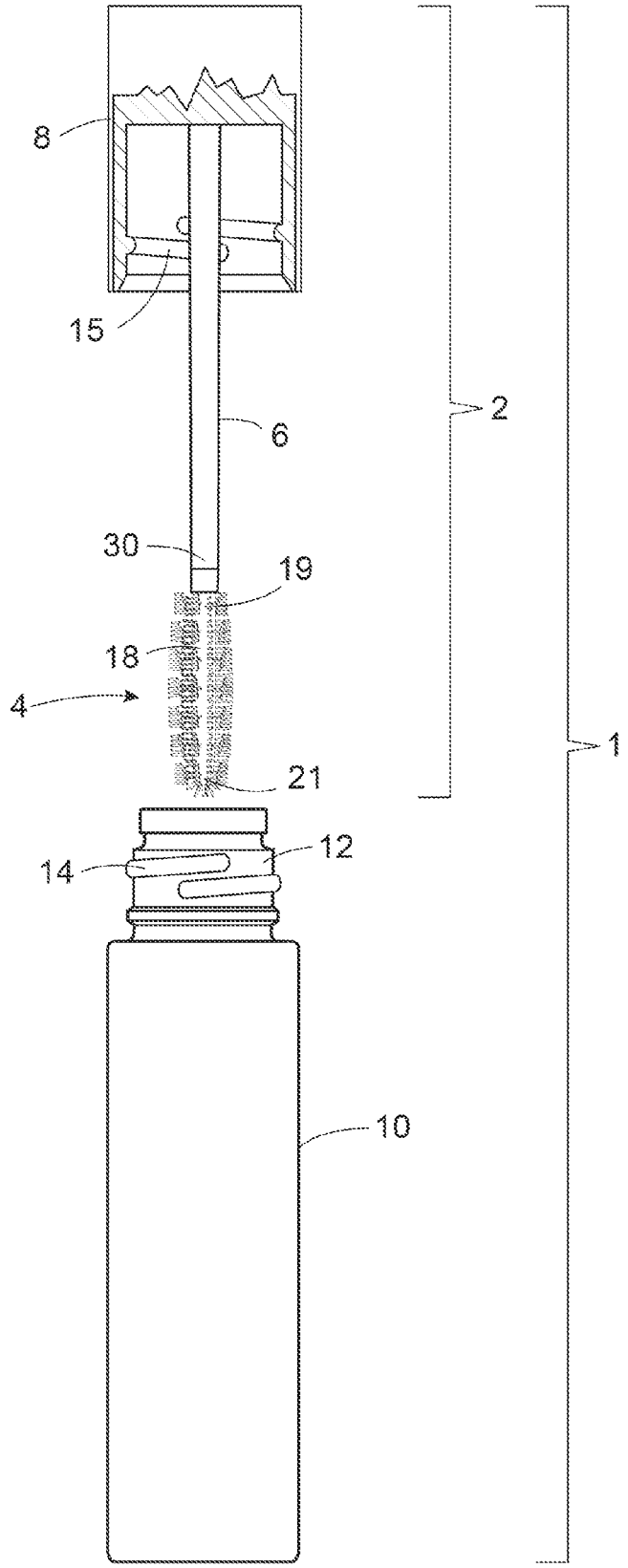
FIG. 1 is an front elevation view of a cosmetic package of the present invention including an applicator illustrated in a position withdrawn from and above a cosmetic product vial.
Figure 4:
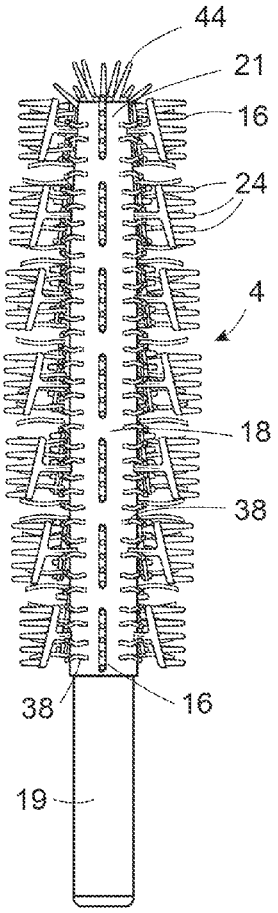
FIGS. 4-6 are right, back and left elevation views of the brush head portion shown in FIG. 2.
Figure 5:
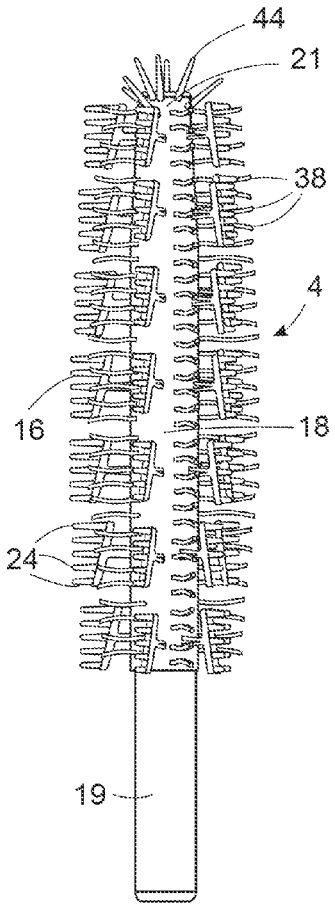
Figure 6:
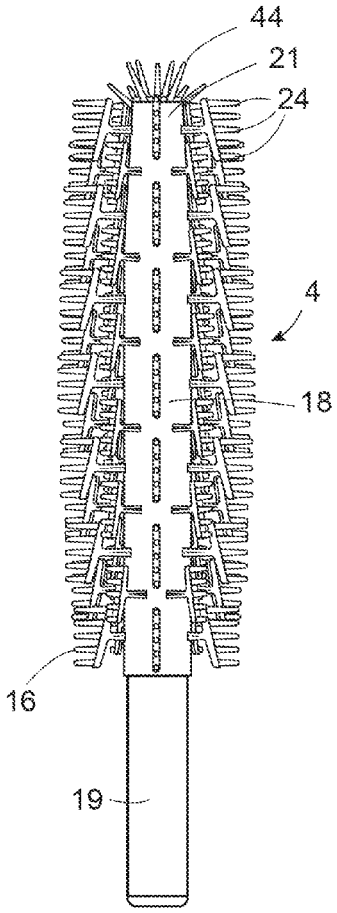
Figure 7:
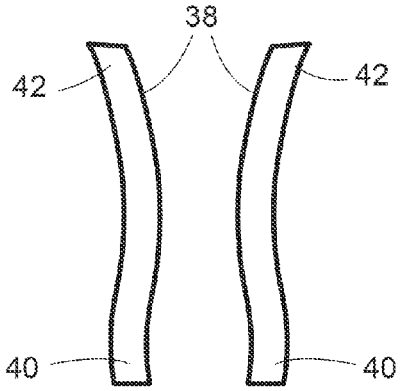
FIG. 7 is a detail elevation view of a single shaft tooth of the present invention.

Referring now to FIGS. 1-10, a cosmetic package 1 (FIG. 1) is shown with a cosmetic applicator 2 in a position withdrawn from and above a cosmetic product vial 10. The applicator includes a brush head 4, a stem rod 6 and a handle 8 that also serves as a cap for the vial 10. The stem rod 6 is connected to and depends from the handle 8. The stem rod 6 extends from the handle 8 to a support end 30. The vial 10 has a neck 12 defining an opening 13 into a product reservoir 17 (see FIG. 11) with a screw thread 14 externally thereon. A wiper 26 is secured in the neck opening 13 of the neck 12.

The wiper 26 has a wiper orifice 28 defining a first cross-sectional dimension 32. The handle 8 can also serve as a cap for the vial 10. For this purpose, the handle/cap may be secured to the neck 12 of the vial 10 by suitable means for securing, such as, for example, the external screw thread 14 on the neck cooperating with an internal screw thread 15 in the handle 8.

Referring now to FIGS. 2-3, the brush head 4 has a core 18 with a proximal end 19 connected and secured to the support end 30 of the stem rod 6. The core 18 extends to a distal end 21. A longitudinal axis 23 is defined through the core from the proximal end 19 to the distal end 21. The core 18 has a second cross-sectional dimension 34 that is less than the first cross-sectional dimension 32 of the wiper orifice 28 such that a deposit of cosmetic product remains at or near the core 18 when the brush head 4 is withdrawn from the product reservoir 17 through the wiper 26.

Figure 8:
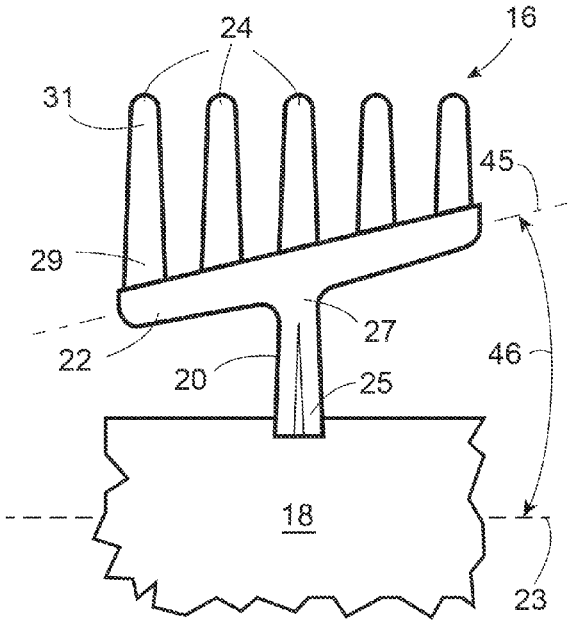
FIG. 8 is a detail elevation view of a 'rake' tooth of the present invention.
Figure 9:
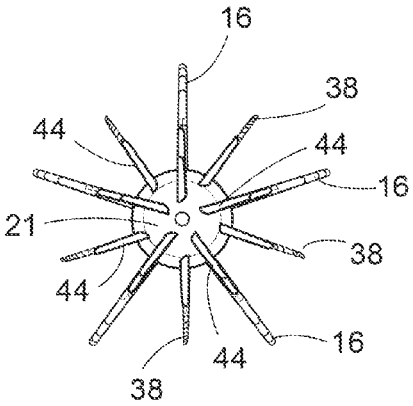
FIG. 9 is a bottom plan view of the brush head portion shown in FIG. 2.
Figure 10:
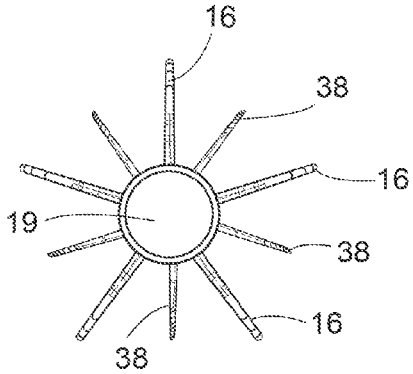
FIG. 10 is a top plan view of the brush head portion shown in FIG. 2.

A plurality of rake-like teeth 16 are secured to the core 18 and extend radially therefrom. As shown in FIGS. 2-3 and 8 (illustrating a single tooth of the plurality of teeth), each of the plurality of rake-like teeth 16 has a single post 20 with an inner end 25 connected to the core 18, the post 20 extending radially outwardly from the core 18 in a direction perpendicular to the longitudinal axis 23 of the core 18 to an outer end 27. A transverse beam 22 is connected to the outer end 27 of the post 20. A long axis 45 of the beam 22 is generally perpendicular to the post 20. At least two tines 24 are connected to the beam 22. Each tine 24 has a first end 29 connected to the beam 22 and each tine 24 extends generally perpendicular to the longitudinal axis 23 of the core to a free end 31. Accordingly, the vertical post 20 supports the generally horizontal transverse beam 22 which in turn supports the plurality of vertical tines 24. In the first embodiment illustrated in FIGS. 1-10, the transverse beam 22 is slightly angled from a perpendicular position with respect to post 20, or, correspondingly, slightly angled from a parallel position with the longitudinal axis 23 of the core 18 of brush head 4. The preferred angle 46 of the beam 22 relative to the longitudinal axis 23 of the core 18 is from 1° to 30°, more preferred from 5° to 20° and most preferred from 10° to 15°. As illustrated in the figures, the angle is 13.81°. However, the beam 22 may also be exactly perpendicular to the post 20, i.e., exactly parallel with the longitudinal axis 23 of the core 18 of brush head 4. The beam 22 may be straight or may be curved in any plane (see, for example, FIG. 15, reference number 222). In the first embodiment illustrated, five tines 24 are supported on the beam 22. However, the plurality of tines 24 may include as few as two (2) tines 24 or more than five (5) tines 24, or any number in between. Preferably, but not necessarily, the beam 22 may have an average length ranging from about 1 mm to about 8 mm; more preferably from about 4 mm to about 5 mm and most preferably from about 2 mm to about 3 mm.

Preferably, but not necessarily, each post 20 has an average height ranging from about 0.5 mm to about 8 mm. More preferably, each post 20 has an average height ranging from about 3 mm to about 5 mm and most preferably, each post 20 has an average height ranging from about 1.5 mm to about 3 mm.

Preferably, but not necessarily, the tines 24 have an average height ranging from about 0.5 mm to about 6 mm, more preferably from about 2 mm to about 3 mm and most preferably from about 1 mm to about 1.5 mm.

The average cross-sectional diameter of the teeth preferably ranges from about 0.1 mm to about 2 mm, more preferably from about 0.2 mm to about 1.5 mm, and most preferably from about 0.3 mm to about 0.9 mm.

The tines 24 may be straight or curved. The tines 24 may be perpendicular with respect to the beam 22, i.e., parallel to a long axis of the post 20. Alternatively, the tines 24 may be angled in any direction with respect to the beam 22 or post 20.

The plurality of rake-like teeth 16 define a third cross-sectional dimension 36 for the brush head that is larger than the first cross-sectional dimension 32 of the wiper orifice 28. The post 20 of each of the plurality of the teeth 16 is flexible to permit the teeth 16 to bend as the brush head 4 is withdrawn from the product reservoir 17 through the wiper orifice 28 such that the tines 24 load cosmetic product from that deposited at or near the core 18 and retains the loaded cosmetic product as the teeth 16 return to an upright position.

Figure 11:
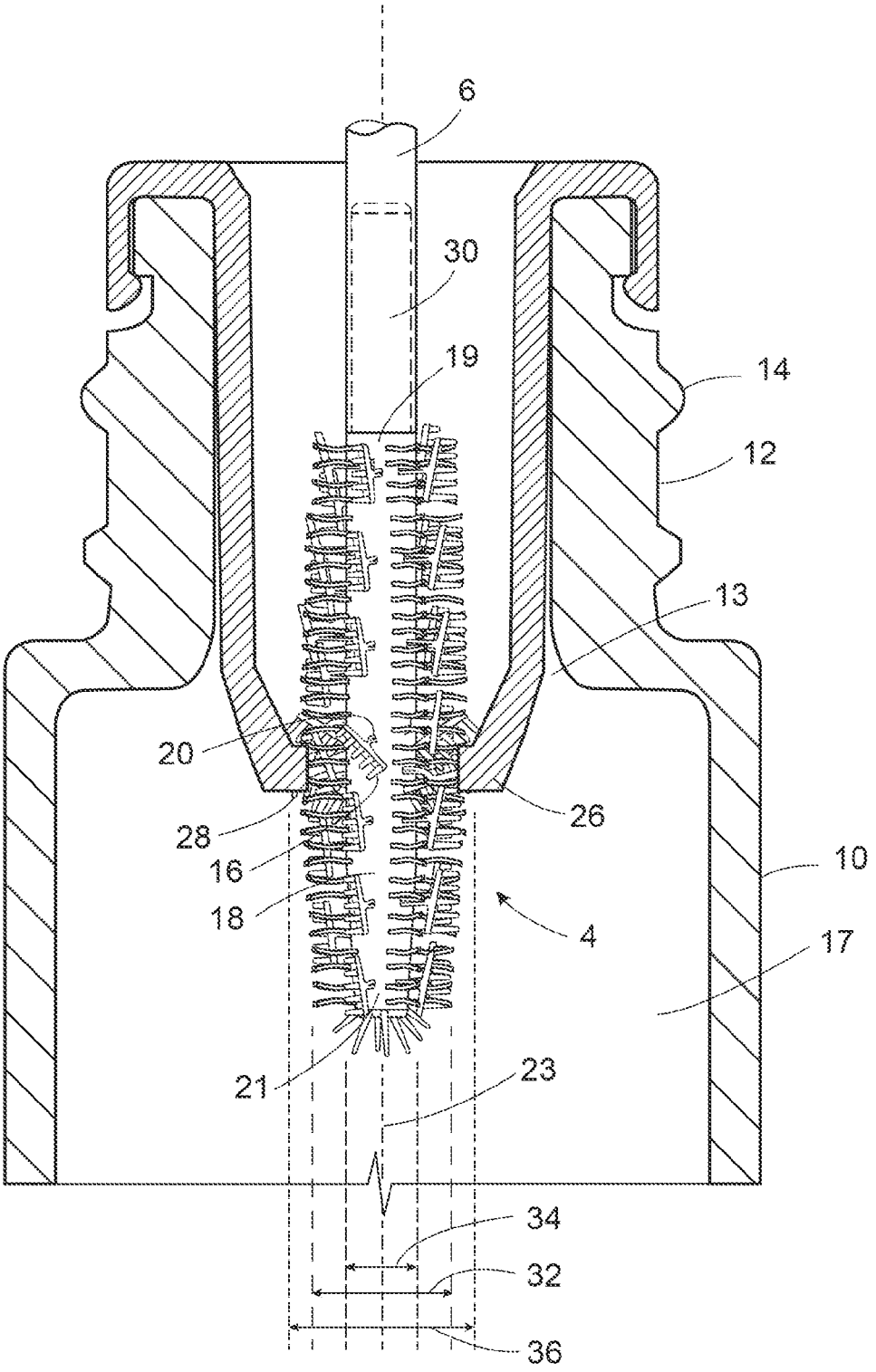
FIG. 11 is a partial sectional view of the brush head portion being drawn through a wiper in the product vial.

This is illustrated in FIG. 11, a cross-sectional view of the brush head 4 partially withdrawn through the wiper 26. To accommodate the passage of the larger diameter brush head 4 through the smaller diameter of the wiper orifice 28, the posts 20 of the teeth 16 are provided with a degree of flexibility to allow the teeth 16 to bend as the brush head 4 passes through the wiper (see FIG. 11). The teeth 16 bend towards the core 18 as the brush head 4 passes through wiper 26, and return to an upright position after exiting the wiper 26. The smaller diameter of the orifice 28 of the wiper 26 removes excess product from the brush head 4 as the applicator 2 is drawn out of the vial 10, but the orifice 28 is dimensioned to leave a deposit of cosmetic product at or near the core 18 of the brush head 4. As noted above, the orifice 28 of the wiper 26 pushes the teeth 16 toward the core 18 as the brush head moves through the wiper 26. When the teeth 16 are pushed toward the core 18, the tines 24 on the beam 22 dip into the cosmetic product deposited at or near the core 18. The tines 24 pick up a supply of cosmetic product from the deposit at or near the core 18. As the teeth 16 return to the upright position by way of plastic memory, the tines 24 carry this supply of cosmetic product from the core 18 such that cosmetic product in good amount is available near the surface of the brush, i.e., near the free ends 31 of the tines 24. In this way, cosmetic product supply is best located for improved application to lashes or other surfaces.

The applicator 2, including the core 18 and teeth 16, may be molded as a unitary body from a suitable plastic material, or the handle 8, stem rod 6 and brush head 4 may be molded separately of different materials and assembled by conventional means, such as, for example, gluing, bonding, press-fit or friction fit, welding, sonic welding, over-molding, etc. Preferably, the brush head 4 with rake-like teeth 16 comprising a core 18, post 20, beam 22 and tines 24 is molded as a unitary body from a single material such as, for example, any suitable plastic material. Preferred materials are, for example, polymers including silicone elastomers, thermoplastic elastomers (e.g., styrene-ethylene-butylene-styrene block copolymer—SEBS), vinyl elastomers (EVA), thermoplastic polyester elastomers (e.g., Hytrel® from DuPont de Nemours), thermoplastic polyurethane elastomers (pelethane® from Dow Plastic), Nitrile or EPDM. Hardness of the material is preferably from about 35 MPa (35 Shore D Hytrel® from DuPont de Nemours) to about 1180 MPa (82 Shore D Hytrel® from DuPont de Nemours). More preferably, tensile modulus ranges from about 95 MPa (45 Shore D Hytrel® from DuPont de Nemours) to about 570 MPa (72 Shore D Hytrel® from DuPont de Nemours). Most preferably, tensile modulus ranges from about 200 MPa (55 Shore D Hytrel® from DuPont de Nemours) to about 280 MPa (63 Shore D Hytrel® from DuPont de Nemours), i.e., materials compounded to provide a degree of flexibility to the post 20 of the teeth 16. Alternatively, the applicator 2 is molded from the plastic material by any suitable molding means, such as, for example, casting or injection molding. The resulting cosmetic applicator brush has excellent loading, combing, separating and volumizing properties when used on the eyelashes or eyebrows. It provides a high degree of make-up definition and an increased volumizing effect by delivering larger quantities of makeup product, such as mascara, to lashes or brows.

The brush head 4 may also include a plurality of single shaft teeth 38 each having a root end 40 secured to the core 18, and each extending out from the core to a free tip 42. Each of the plurality of single shaft teeth 38 extends radially from the core 18 between the proximal and distal ends, 19, 21, respectively, of the core 18 at locations between adjacent ones of the plurality of rake-like teeth 16. The single shaft teeth 38 may be straight to wavy as shown. Each of the plurality of rake-like teeth 16 may be arranged in a first row along the length of the core 18, and each of the plurality of single shaft teeth 38 may be arranged in a second row along the length of the core. A plurality of first rows of rake-like teeth and a plurality of second rows of single shaft teeth may be provided on the brush head, and each row of the plurality of first rows of rake-like teeth alternates with a row of the plurality of second rows of single shaft teeth (see FIGS. 9-10). The rows of single shaft teeth 38 provide improved combing and doctoring capability to the brush head 4.

Additional single shaft teeth 44 may be secured to the distal end 21 of the core 18 and extend outwardly from the distal end 21. The additional single shaft teeth 44 extend from the distal end of the core at an angle of from about 0 degrees to about 90 degrees relative to the longitudinal axis 23 of the core 18.

Figure 12:
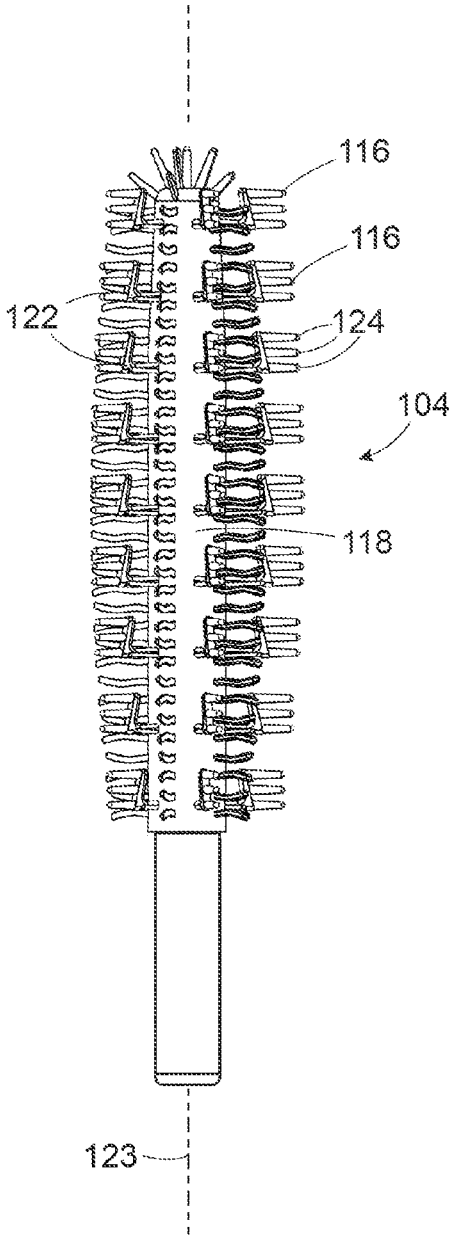
FIGS. 12-13 are front and left side elevation views of a second embodiment of the brush head portion of the invention, rear and right elevation views, respectively, being mirror images thereof.
Figure 13:
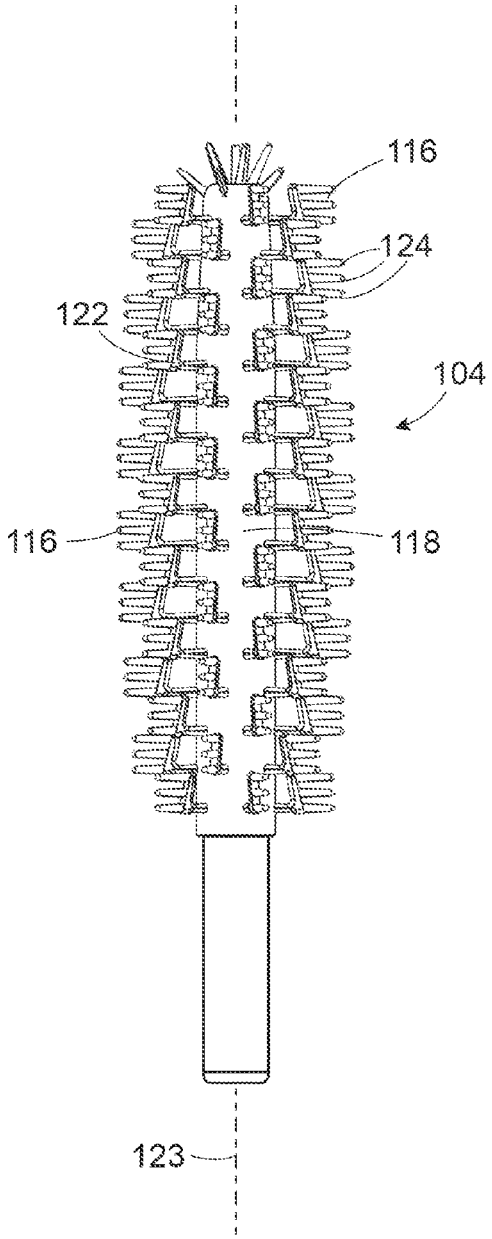
Figure 14:
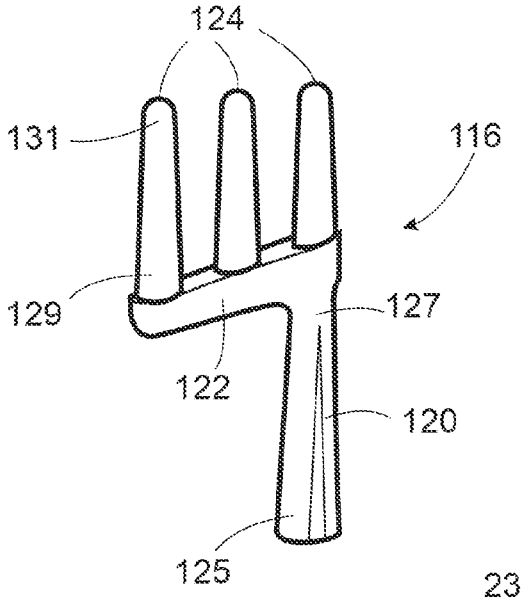
FIG. 14 is a detail elevation view of the rake tooth of the second embodiment shown in FIGS. 12-13.

Referring now to FIGS. 12-14, a second embodiment is illustrated with a brush head 104 having rake-like teeth 116. The second embodiment includes rake-like teeth 116 with a single post 120 with an inner end 125 for connected to the core 118. The post 120 extends radially outwardly from the core 118 in a direction perpendicular to the longitudinal axis 123 of the core 118 to an outer end 127. A transverse beam 122 is connected to the outer end 127 of the post 120. A long axis of the beam 122 is generally perpendicular to the post 120. Three tines 124 are connected to the beam 122. Each tine 124 has a first end 129 connected to the beam 122 and each tine 124 extends generally perpendicular to the longitudinal axis 123 of the core to a free end 131.

Figure 15:
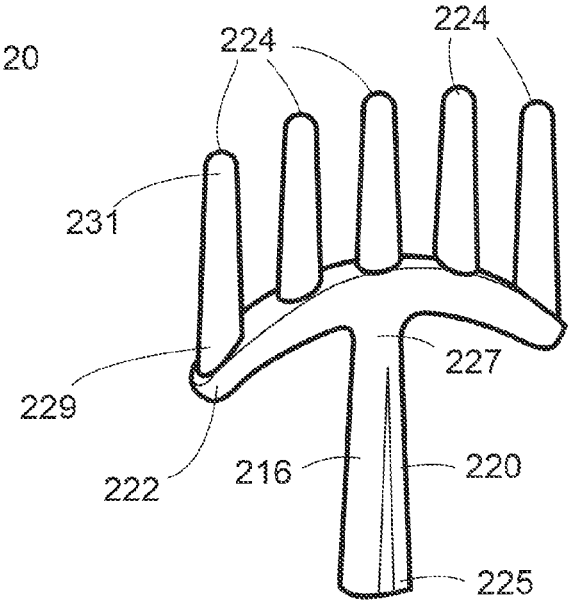
FIG. 15 is a detail elevation view of a rake tooth of a third embodiment of the invention.
Figure 16:
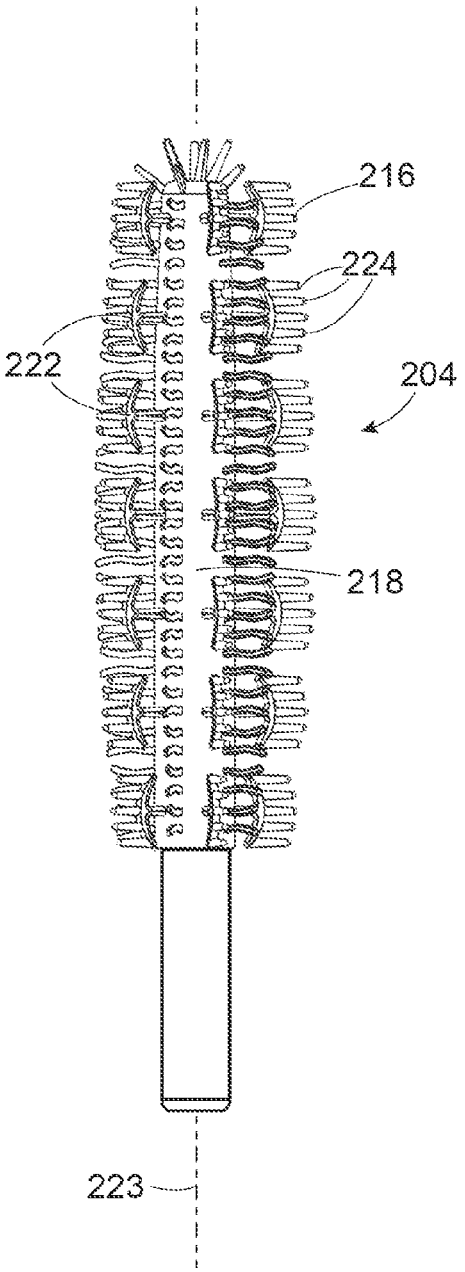
FIGS. 16-17 are front and left side elevation views of the third embodiment of the brush head portion of the invention, rear and right elevation views, respectively, being mirror images thereof.
Figure 17:
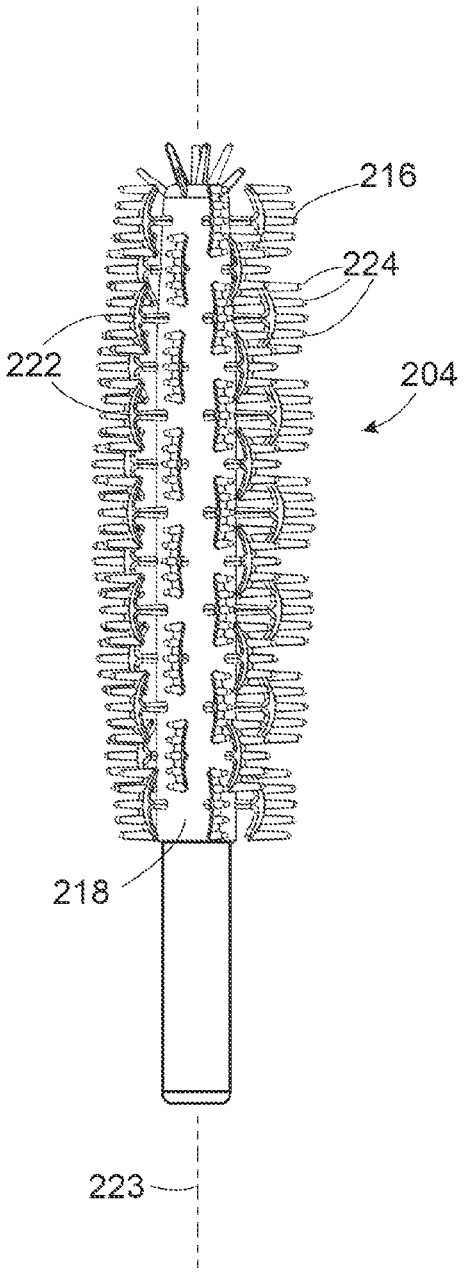

Referring now to FIGS. 15-17, a third embodiment is illustrated with a brush head 204 having rake-like teeth 216. The third embodiment includes rake-like teeth 216 with a single post 220 with an inner end 225 for connected to the core 218. The post 220 extends radially outwardly from the core 218 in a direction perpendicular to the longitudinal axis 223 of the core 118 to an outer end 127. A transverse beam 222 is connected to the outer end 227 of the post 220. A long axis of the beam 222 is generally perpendicular to the post 220, but the beam 222 is convexly curved relative to the axis 223. The beam 222 could similarly be concavely curved (not shown) relative to the axis 223. Five tines 224 are connected to the beam 222, but the curved beam 222 could support any suitable number of tines. Each tine 224 has a first end 229 connected to the beam 222 and each tine 224 extends generally perpendicular to the longitudinal axis 223 of the core to a free end 231.

The objective of this invention is to load cosmetic product on the tines 24, 124, 224, and in particular near the free ends 31, 131, 231, of the tines. This is accomplished by providing the flexibility to the post 20, 120, 220 of the rake-like teeth 16, 116, 216. The beam 22, 122, 222, may be straight or curved in any plane, and may be symmetric or asymmetric relative to the position on the outer end 27, 127, 227, of the post 20, 120, 220.

Adjacent tines 24 on the beam 22 may be the same height from the first end to the free end or may vary in height along the length of the beam. For example, in the first and second embodiment, adjacent tines 24, 124, respectively, vary in height along the length of the respective beam 22, 122. In the third embodiment, the five adjacent tines 224 each have the same height along the length of the beam 222, but as the beam is convexly curved relative to the axis 223, the free ends 231 of adjacent tines 224 are at different relative heights with respect to the core of the brush.

As noted above, as a conventional brush is withdrawn through a wiper, the greatest quantity of cosmetic product, e.g., mascara, is deposited and located near the core of the brush and not at the tips of the bristles of the brush. It is known that lashes may not easily penetrate the outer surface of a brush applicator between the bristles to access the cosmetic product loaded at or near the core of the brush.

The present invention overcomes this shortcoming in the prior art by providing a brush head with rake-like teeth that bend and scoop up cosmetic product from near the core as the brush is withdrawn from the vial through the wiper opening. During the wiping process, i.e., when the brush head 4 is withdrawn through the wiper 26, the wiper orifice 28 displaces the flexible rake-like teeth 16 toward the center of the brush, towards the core 18 of the brush. In the displaced position, the tines 24 of the teeth 16 load or pickup product from the deposit near the core and carry it to the surface of the brush as the teeth return to an upright position by the plastic memory of the underlying material. The cosmetic loaded at or near the free ends 31 of the tines 24 is more readily available for delivery and release upon application to, for example, eyelashes.

Because the present invention loads a majority of cosmetic product at or near the free ends of the tines 24, 124, 224, it provides a high degree of product delivery to lashes and hair, resulting in a volumizing effect upon delivery. The brush provides a high loading on the eyelashes and then a high volumizing make-up result. The rake-like teeth allows loading and delivery of cosmetic product such as, for example, mascara, that is substantially better than loading and delivery by conventional teeth, tines or bristles. Each rake-like tooth 16 acts as a tank or reservoir holding a supply of cosmetic product to be delivered upon application to lashes or hair. This applicator can be used for mascara, eyelash or eyebrow treatment, or for other eyelash or eyebrow products.

It is understood that various modifications and changes in the specific form and construction of the various parts can be made without departing from the scope of the following claims.

What is claimed is:

1. A cosmetic package comprising:

a vial having a neck defining an opening into a product reservoir, a wiper secured in the opening, the wiper having a wiper orifice defining a first cross-sectional dimension, and an applicator having a handle, a stem rod connected to and depending from the handle, the stem rod extending from the handle to a support end, and a brush head having:

a core with a proximal end connected to the support end of the stem rod, the core extending from the proximal end to a distal end, a longitudinal axis defined through the core from the proximal end to the distal end, the core having a second cross-sectional dimension that is less than the first cross-sectional dimension of the wiper orifice such that a deposit of cosmetic product remains at or near the core when the brush head is withdrawn from the product reservoir through the wiper, and a plurality of rake-like teeth secured to the core, each of the teeth comprising:

a post having an inner end secured to the core, the post extending radially outwardly from the core in a direction perpendicular to the longitudinal axis of the core to an outer end;

a beam secured to the outer end of the post, the beam generally perpendicular to the post, or at an angle relative to the longitudinal axis of the core of from 1° to 30°; and at least two tines, each tine having a first end secured to the beam and each tine extending generally perpendicular to the longitudinal axis of the core to a free end;

wherein the plurality of rake-like teeth define a third cross-sectional dimension for the brush head that is larger than the first cross-sectional dimension of the wiper orifice, and the post of each of the plurality of the teeth is flexible to permit the teeth to bend as the brush head is withdrawn from the product reservoir through the wiper orifice such that the at least two tines of each of the plurality of teeth pick up cosmetic product from the deposit at or near the core and retain the cosmetic product as the teeth return to an upright position.

2. The cosmetic package of claim 1 wherein the handle is a cap for the vial.

3. The cosmetic package of claim 2 further comprising an internal thread in the cap and a cooperating external thread on the neck for securing the cap to the vial.

4. The cosmetic package of claim 1 further comprising a plurality of single shaft teeth, each having a root end secured to the core and each extending out from the core to a free tip.

5. The cosmetic package of claim 4 wherein the plurality of single shaft teeth extend from the distal end of the core at an angle of from about 0 degrees to 90 degrees relative to the longitudinal axis of the core.

6. The cosmetic package of claim 4 wherein each of the plurality of single shaft teeth extends radially from the core between the proximal and distal ends of the core at locations between adjacent ones of the plurality of rake teeth.

7. The cosmetic package of claim 6 wherein each of the plurality of rake-like teeth are arranged in a first row along the length of the core, and the plurality of single shaft teeth are arranged in a second row along the length of the core.

8. The cosmetic package of claim 7 further comprising a plurality of first rows of rake-like teeth and a plurality of second rows of single shaft teeth, and each of the plurality of first rows of rake-like teeth alternates with each of the plurality of second rows of single shaft teeth.

9. The cosmetic package of claim 1 wherein the at least two tines comprises two to six tines.

10. The cosmetic package of claim 1 wherein the at least two tines comprises three tines.

11. The cosmetic package of claim 1 wherein the at least two tines comprises four tines.

12. The cosmetic package of claim 1 wherein the at least two tines comprises five tines.

13. The cosmetic package of claim 1 wherein the beam is curved.

14. The cosmetic package of claim 1 wherein the at least two tines comprises three or more tines.

15. The cosmetic package of claim 1 wherein the beam is secured to the outer end of the post at an angle relative to the longitudinal axis of the core of from 5° to 20°.

16. The cosmetic package of claim 1 wherein the beam is secured to the outer end of the post at an angle relative to the longitudinal axis of the core of from 10° to 15°.

17. The cosmetic package of claim 1 wherein the beam is secured to the outer end of the post at an angle relative to the longitudinal axis of the core of 13.81°.

* * * * *